US005614348A

United States Patent [19]

Inoue et al.

[11] Patent Number: 5,614,348

[45] Date of Patent: Mar. 25, 1997

[54] TONER FOR NON-MAGNETIC ONE-COMPONENT DEVELOPMENT AND METHOD FOR CONTACT TYPE DEVELOPMENT USING THE SAME

[75] Inventors: Kazushige Inoue; Yoshihisa Kuramae; Takashi Nagai; Toru Takatsuna, all of Osaka, Japan

[73] Assignee: Mita Industrial Co., Ltd., Osaka, Japan

[21] Appl. No.: 530,618

[22] Filed: Sep. 20, 1995

[30] Foreign Application Priority Data

Oct. 4, 1994 [JP] Japan ..... 6-240268

[51] Int. Cl.[6] ..... G03G 9/097

[52] U.S. Cl. ..... 430/110; 430/120

[58] Field of Search ..... 430/106, 109, 430/110, 111, 120

[56] References Cited

U.S. PATENT DOCUMENTS

| | | | |
|---|---|---|---|
| 4,943,504 | 7/1990 | Tomura et al. | 430/102 |
| 5,306,589 | 4/1994 | Yamamoto et al. | 430/109 |
| 5,328,792 | 7/1994 | Shigemori et al. | 430/109 |

FOREIGN PATENT DOCUMENTS

| | | |
|---|---|---|
| 0445986 | 9/1991 | European Pat. Off. . |
| 59-189355 | 10/1984 | Japan . |
| 60-115945 | 6/1985 | Japan . |
| 01193869 | 8/1989 | Japan . |
| 2170917 | 8/1986 | United Kingdom . |

*Primary Examiner*—John Goodrow

*Attorney, Agent, or Firm*—Beveridge, DeGrandi, Weilacher & Young, L.L.P.

[57] ABSTRACT

The present invention provides a toner 1 for non-magnetic one-components developments to be used for a method for non-magnetic one-component contact type development, wherein an apparent density is not less than 0.32 g/cc and when supplying to a developing roller 2 immediately after the consumption at the black solid part, a charged amount is not less than 7 μC/g at an absolute value. This toner is suitable for using in combination with an organic photoconductor and can prevent that a residual image of the black solid part is remained at the half tone part immediately after the development of the black solid part.

7 Claims, 2 Drawing Sheets

TONER FOR NON-MAGNETIC ONE-COMPONENT DEVELOPMENT AND METHOD FOR CONTACT TYPE DEVELOPMENT USING THE SAME

BACKGROUND OF THE INVENTION

The present invention relates to a toner for non-magnetic one-component development, which is used for facsimile, copying machine, laser printer, etc. More particularly, it relates to a toner for non-magnetic one-component development, which is suitable for using in combination with a single-layer type organic photoconductor, and a method for contact type development using the same.

In copying machines using an electrophotographic system, a simple method for one-component insulating toner development, particularly method for non-magnetic one-component contact type development (impression development) has recently been proposed in place of a method for two-component magnetic brush development, and the research and development thereof has been making progress.

The method for non-magnetic one-component contact type development is a kind of a method for reversal development. In this method, as shown in FIG. 1, a toner 1 being a non-magnetic one-component developer is charged by friction charging with a developing roller 2, and then adhered on the surface of the developing roller 2 by an action of a control blade 3 and an image force to form a homogeneous thin film of the toner particle on the developing roller 2. Thereafter, this thin film is contacted directly with an electrostatic latent image formed on a photoconductor drum 4 to actualize the electrostatic latent image as a visual image. The toner 1 is supplied from a toner hopper 5, and then supplied to the developing roller 2 through a toner supply roller 7 while agitating with a toner agitator 6.

The toner for non-magnetic one-component development to be used for such a method for non-magnetic one-component contact type development is formed by optionally adding a surface treating agent such as hydrophobic silica particle to a toner particle wherein a colorant such as carbon black is contained in a fixing resin.

On the other hand, an organic photoconductor (OPC) is used in place of a conventional inorganic photoconductor using amorphous selenium, amorphous silicon, etc. for the photoconductor drum, according to a request to remove environmental pollution. The organic photoconductor is obtained by dispersing a photoconductive polymer or lower molecular compound in a binding resin, and included a so-called function separating type organic photoconductor comprising an electric charge generating layer and an electric charge transferring layer, which are mutually laminated, i.e. multi-layer type photoconductor, and a single-layer type photoconductor comprising an electric charge generating material and an electric charge transferring material, which are contained in a single photosensitive layer.

A conventional toner to be used for the method for non-magnetic one-component contact type development had a problem in build up of charging. Furthermore, the residual potential of the organic photoconductor is high in general, and the potential width which can be used for developing is narrow. Accordingly, high level has hitherto been requested to the charging stability of the toner.

As a result, the charged amount of the toner supplied to the developing roller after the black solid part was developed becomes low. Therefore, there was a problem that the residual image of the black solid part is remained at the half tone part when the half tone is developed immediately after the black solid development, which results in excessively black half tone part. To remain the above residual image is also referred to as "leaving trail."

That is, FIG. 2 is a developing sensitivity curve illustrating a relation between the developing bias (i.e. effective potential difference which is a difference between the potential of the surface of the photoconductor and actual developing bias) and image density, and a solid line shows a curve at the normal state. The black solid part is developed when the developing bias is (a), i.e., normally about +300 to +200 V. The half tone part is developed when the developing bias is (b), i.e., normally about +100 V. At this point, the image density of the half tone part is represented by (I). Incidentally, the white part is obtained when the developing bias is (c), i.e., normally about −400 V. To the contrary, when the amount of the charged amount of the toner becomes small, a rapid build up is observed as shown by the chain line. Therefore, there is a problem that the image density becomes (I+α) when the half tone part is developed at the same developing bias (b) and the image density becomes high by the amount of α. It is considered that such a problem arises because the charged amount of the toner is low, thereby decreasing a force of returning the toner to the developing roller by the electric field. This tendency becomes more remarkable when using an organic photoconductor having a high residual potential, particularly single-layer type organic photoconductor.

SUMMARY OF THE INVENTION

It is a main object of the present invention to provide a toner for non-magnetic one-component development, of which charging properties are improved, and which has solved a problem that a black solid residual image is remained at the half tone part immediately after the black solid is developed, even if it is used in combination with an organic photoconductor having a high residual potential, and a method for contact type development using the same.

The present inventors have intensively studied in order to accomplish the above object. As a result, it has been found that, when using a toner for non-magnetic one-component development wherein an apparent density is not less than 0.32 g/cc and, when supplying to a developing roller immediately after the consumption at the black solid part, a charged amount is not less than 7 μC/g, as an absolute value, there can be solved a problem in the method for non-magnetic one-component contact type development that the residual image of the solid part (hereinafter referred to as an "image memory") is remained at the half tone part immediately after the black solid development, thus the present invention has been accomplished.

The term "apparent density" used herein means a weight per unit volume (g/cc) obtained when a predetermined container is filled with a toner under no load, and is a criterion of the fluidity of the toner. The apparent density of the toner of the present invention is not less than 0.32 g/cc, preferably 0.33 to 0.40 g/cc. Thereby, the above image memory can be considerably reduced in cooperation with the above definition of the charged amount and, at the same time, the fluidity of the toner is improved. Therefore, fusing of the toner onto the blade is scarcely generated and the wear amount of the drum becomes small. In order to set the apparent density of the toner at not less than 0.32 g/cc, there can be used a method of selecting a surface treating agent having a good fluidity and adjusting the amount to be surface-treated, a method of forming a toner particle into a sphere form, or a method of using these methods in combination.

Furthermore, the charged amount of the toner to be supplied to the developing roller immediately after the consumption at the black solid part, i.e., new toner, is not less than 7 μC/g, preferably 10 to 30 μC/g as an absolute value. When the charged amount is less than 7 μC/g, a force of returning the toner to the developing roller by the electric field becomes small in the half tone development immediately after the development at the black solid part, thereby generating an image memory, and it is not preferred. In order to set the charged amount at not less than 7 μC/g as an absolute value, it is preferred in using the method for non-magnetic one-component development to use a method of increasing an amount of an electric charge controlling material to be described later or a method of improving the fluidity of the toner to increase a chance of a contact charging.

The toner of the present invention is produced by adding a surface treating agent to a toner particle wherein a colorant is dispersed in a fixing resin to carry out a surface treatment.

Furthermore, the method for contact type development using the toner of the present invention comprises the steps of charging the above toner by friction charging with a developing roller, to which a developing bias has been applied, to form a thin film of the toner on the surface of the developing roller, and bringing the toner thin film into contact with an electrostatic latent image formed on the surface of an organic photoconductor to visualize the electrostatic latent image.

The surface of the photoconductor is charged to the same polarity as that of the toner, and then the photoconductor is exposed to light to form an electrostatic latent image of which potential is lower than a developing bias.

According to the present invention, it is preferred that the toner is a positive charging toner and the organic photoconductor is a single-layer type positive charging organic photoconductor.

Other objects, features and advantages of the present invention will become apparent to those skilled in the art from the following description.

DETAILED DESCRIPTION OF THE INVENTION

Figure 1:
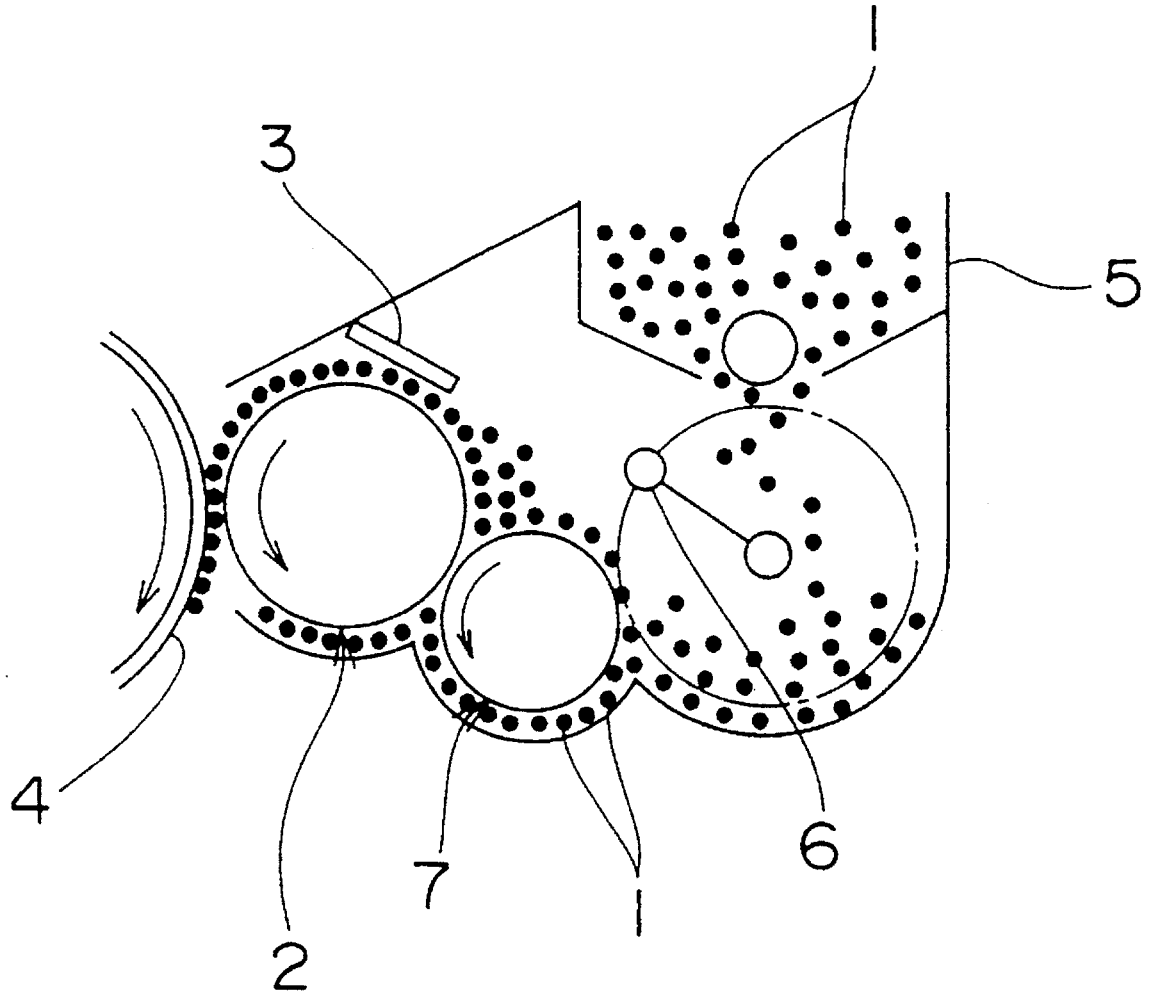
FIG. 1 is a schematic diagram illustrating a method for non-magnetic one-component contact development.
Figure 2:
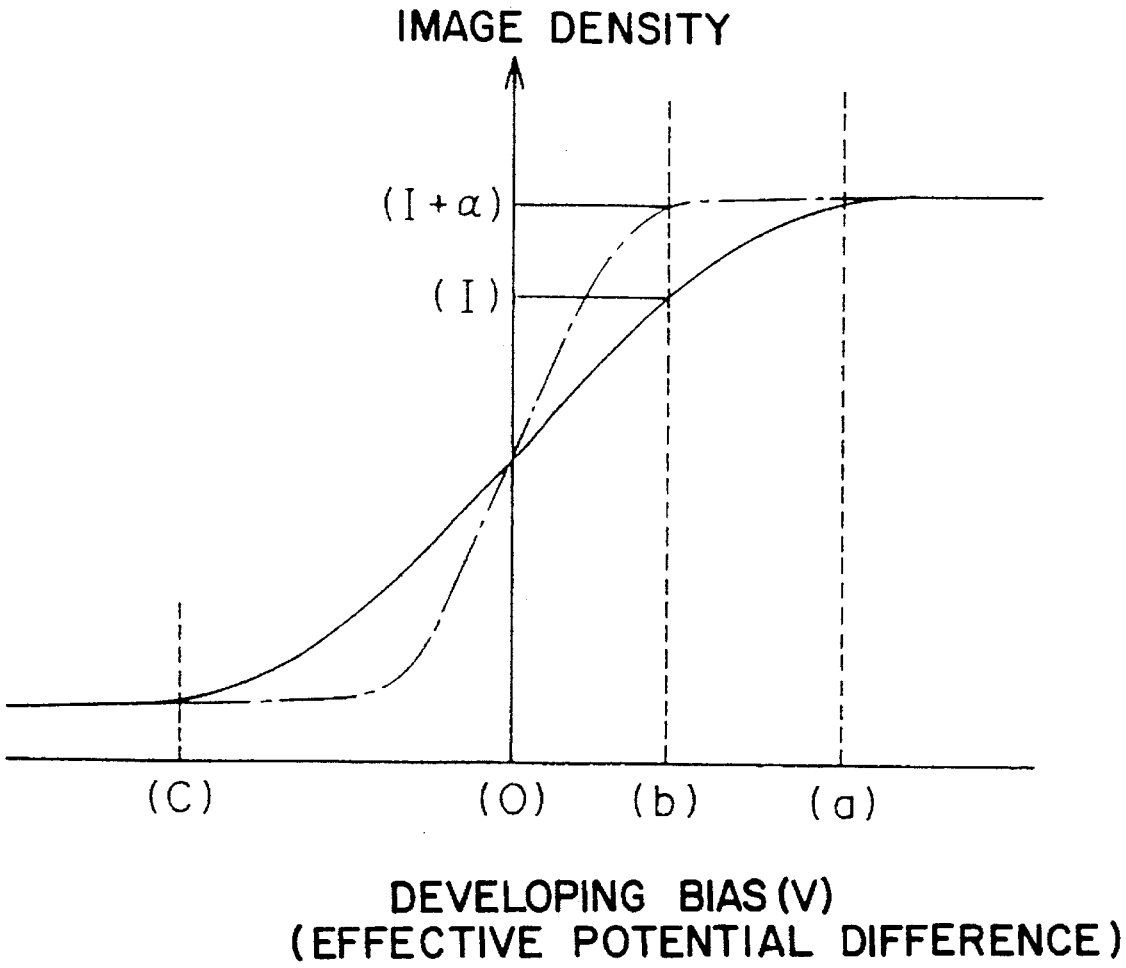
FIG. 2 is a developing sensitivity curve illustrating a relation between the developing bias and image density.

Examples of the fixing resin constituting the toner particle include styrene resin (homopolymer or copolymer containing styrene or a substituted styrene such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylate copolymer (e.g. styrene-methyl methacrylate copolymer, styrene-ethyl methacrylate copolymer, styrene-butyl methacrylate copolymer, styrene-phenyl methacrylate copolymer, etc.), styrene-α-chloromethyl acrylate copolymer, styrene-acrylonitrile-acrylate copolymer, etc.; polyvinyl chloride, low-molecular weight polyethylene, low-molecular weight polypropylene, ethylene-ethyl acrylate copolymer, polyvinyl butyral, ethylene-vinyl acetate copolymer, rosin-modified maleic resin, phenol resin, epoxy resin, polyester resin, ionomer resin, polyurethane resin, silicone resin, ketone resin, xylene resin, polyamide resin and the like. These may be used alone or in combination thereof.

It is particularly preferred that the fixing resin is neutral. The neutral fixing resin often exerts no bad influence on the charging characteristics of the toner particle and has a high transparency in comparison with an acidic or basic fixing resin. Therefore, there is no any fear that it exerts a bad influence on coloring of the toner particle due to a colorant such as carbon black, etc.

As the colorant, there can be used various dyes, pigments, etc. which have hitherto been known. Among them, carbon black is mainly used in case of a black toner. Examples of the carbon blacks include channel black, roller black, disk black, gas furnace black, oil furnace black, thermal black, acetylene black and the like.

The amount of the carbon black is not specifically limited. However, since the carbon black itself has an electroconductivity, it also plays a role as a control means of charging characteristics and electric properties of the toner particle. Accordingly, it is preferred to set the preferable range of the amount to be added according to the objective performances of the developer. The amount of the carbon black to be blended is normally not more than 10 parts by weight, preferably 1 to 9 parts by weight, based on 100 parts by weight of the fixing resin.

In order to obtain the toner particle, various additives such as electric charge controlling materials, release agents (anti-offset agents), etc. may be added to the fixing resin, in addition to the above components.

As the electric charge controlling material, any one of two sorts of electric charge controlling materials for controlling positive and negative charges or both of them may be used according to the polarity of the toner particle.

Examples of the electric charge controlling material for controlling a positive charge include organic compounds containing a basic nitrogen atom, such as basic dye, aminopyridine, pyrimidine compound, polynuclear polyamino compound, aminosilanes, etc., or fillers surface-treated with the above compounds and the like. In the present invention, there can be suitably used a resin wherein a trialkylammonio group is introduced into the side chain, as the electric charge controlling material. This is because the allowance as to fog of the non-image area becomes large.

As the electric charge controlling resin wherein a trialkylammonio group corresponding to a quaternary ammonium salt is introduced into the side chain, for example, there is a polymer wherein a trialkylammonio group represented by the formula:

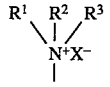

(1)

wherein $R^1$, $R^2$ and $R^3$ are the same or different and indicate a straight-chain or branched alkyl group having 1 to 6 carbon atoms, such as methyl group, ethyl group, n-propyl group, iso-propyl group, n-butyl group, iso-butyl group, tert-butyl group, pentyl group or hexyl group; and X is F, Cl, Br, I, $ClO_4$, $PF_4$ or $BF_4$, is introduced into the side chain. As the main chain of the electric charge controlling resin, there can be used various polymer main chains. The compatibility between the electric charge controlling resin and fixing resin is particularly important in view of charging properties of the toner so that it is preferred to use the polymer main chain having a good compatibility with the polymer to be used as the fixing resin. Among them, it is particularly preferred to use the same polymer main chain as the polymer to be used as the fixing resin. For example, when the styrene-acrylic resin such as styrene-acrylate copolymer, styrene-methacrylate copolymer, etc. is used as the fixing resin, it is preferred to use the same styrene-acrylic resin as the main chain of the electric charge controlling resin. When the main chain is the styrene-acrylic resin, the trialkylammonio group is substituted on the ester moiety of acrylate or methacrylate. It is preferred that the proportion of acrylate or methacrylate of the styrene-acrylic resin to be used is 10 to 50 molar %. Furthermore, the side chain may be carbon chains such as methyl group, ethyl group, in addition to the ester moiety of acrylate or methacrylate.

Furthermore, examples of the electric charge controlling material for controlling a negative electric charge include a compound containing a carboxyl group (e.g. metal alkyl salicylate, etc.), a metal complex salt dye, a fatty acid soap, metal naphthenate, etc.

The electric charge controlling resin may be blended in an amount of 0.1 to 10 parts by weight, preferably 0.5 to 5 parts by weight, based on 100 parts by weight of the fixing resin.

Examples of the release agent (anti-offset agent) include aliphatic hydrocarbons, aliphatic metal salts, higher fatty acids, fatty acid esters or partially saponified material thereof, silicone oil, various waxes and the like. Among them, aliphatic hydrocarbons having a weight-average molecular weight of about 1000 to 10000 are preferred. Examples thereof include low-molecular weight polypropylene, low-molecular weight polyethylene, paraffin wax, low-molecular weight olefin polymer of an olefin unit having not less than 4 carbon atoms, and they may be suitably used alone or in combination thereof.

The release agent may be added in an amount of 0.1 to 10 parts by weight, preferably 0.5 to 8 parts by weight, based on 100 parts by weight of the fixing resin.

The toner particle can be produced by uniformly melting and kneading a mixture obtained by uniformly premixing the above respective components with a dry-blender, Henschel mixer, ball mill, etc., using a kneading apparatus such as Banbury mixer, roll, single- or twin-screw extruder, etc., cooling the resulting kneaded mixture, followed by pulverizing and optional classifying. It can also be produced by a suspension polymerization method.

It is preferred that the particle size of the toner particle is not more than 10 μm for the purpose of enhancing the image quality of the image to be formed. The construction of the present invention can also be used for a toner particle having a particle size of larger than 10 μm.

The surface treating agent (fluidizing agent) can also be added to the surface of the toner particle to improve the fluidity and charging properties. As the surface treating agent, there can be used various materials which have hitherto been known, such as inorganic fine powder, fluorine plastic particle and the like. Among them, silica surface treating agents containing hydrophobic or hydrophilic silica fine particles (e.g. ultrafine particulate silica anhydride, colloidal silica, etc.) are suitably used.

As described above, the toner for non-magnetic one-component development of the present invention is used for a method for non-magnetic one-component contact type development (reversal development). Particularly, it is suitable for using in combination with an organic photoconductor. More preferably, it is suitable for using in combination with a single-layer type positive charging type single-layer organic photoconductor, as a positive charging type toner, and is effective for reducing the generation of an image memory.

The positive charging photoconductor to be used in combination with the positive charging toner is composed by forming a single-layer type positive charging organic photosensitive layer on the surface of an conductive substrate. Such a single-layer type positive charging organic photosensitive layer is composed by blending an electric charge generating material and an electric charge transferring material in the layer of the binding resin.

Examples of the binding resin include synthetic resins which have hitherto been known, such as styrene polymer, acrylic polymer, styrene, acrylic copolymer, ethylene, vinyl acetate copolymer, olefin polymer (e.g. polypropylene, ionomer, etc.), polyvinyl chloride, vinyl chloride-vinyl acetate copolymer, polyester, alkyd resin, polyamide, polyurethane, epoxy resin, polycarbonate, polyalylate, polysulfon, diaryl phthalate resin, silicone resin, ketone resin, polyvinyl butyral, polyether, phenol resin, photosetting resin (e.g. epoxy acrylate, etc.). These binding resins can be used alone or in combination thereof.

Among the above binding resins, there can be suitably used styrene polymer, acrylic polymer, styrene-acrylic copolymer, polyester, alkyd resin, polycarbonate, polyacrylate and the like. Among them, so-called bisphenol type polycarbonates derived from bisphenols represented by the formula (2):

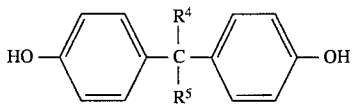

(2)

wherein $R^4$ and $R^5$ are the same or different and indicate a hydrogen atom or a lower alkyl group such as methyl group, ethyl group and the like; and $R^4$ and $R^5$ may bond together with a carbon atom of the main chain to form a cyclic ring such as cyclohexane ring, and phosgene can be used, most preferably.

Examples of the electric charge generating material to be contained in the layer of the binding resin include selenium, selenium-tellurium, amorphous-silicon, pyrylium salt, azo pigments, disazo pigments, anthanthrone pigments, phthalocyanine pigments, indigo pigments, therene pigments, toluidine pigments, pyrazoline pigments, perylene pigments, quinacridon pigments and the like. They may be used alone or in combination thereof so that the resulting photoconductor may have a sensitivity within a desired absorption wavelength range.

Among them, phthalocyanine pigments (e.g. X-type metal-free phthalocyanine, oxotitanylphthalocyanine, etc.), perylene pigments represented by the formula (3):

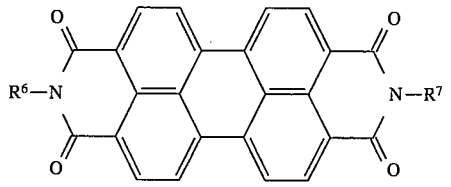

(3)

wherein $R^6$ and $R^7$ are the same or different and respectively indicate an alkyl, cycloalkyl, aryl or aralkyl group having carbon atoms of not more than 18, which may have a substituent, are particularly preferred.

Examples of the alkyl group include methyl group, ethyl group, n-propyl group, iso-propyl group, n-butyl group, iso-butyl group, sec-butyl group, tert-butyl group, 2-ethylhexyl group. Examples of the cycloalkyl group include cyclohexyl group. Examples of the aryl group include phenyl group, napthyl group, tolyl group xylyl group, ethylphenyl group. Examples of the aralkyl group include benzyl group, phenethyl group. Further, examples of the substituent which may be substituted on these groups include lower alkyl groups such as methyl group, ethyl group; alkoxy groups such as methoxy group, ethoxy group; halogen atoms such as chlorine, iodine, bromine.

The electric charge transferring material include an electron transferring material superior in electric transferring properties and a hole transferring material superior in hole transferring properties. Examples of the electron transferring material include electron attractive materials such as para-diphenoquinone derivative, benzoquinone derivative, naphthoquinone derivative, trinitrofluorenoneimine derivative, tetracyanoethylene, tetracyanoquinodimethane, chloroanil, bromoanil, 2,4,7-trinitro-9-fluorenone, 2,4,5,7-tetranitro-9-fluorenone, 2,4,7-trinitro-9-dicyanomthylenefluorenone, 2,4,5,7-tetranitroxanthone, 2,4,8-trinitrothioxanthone, etc., high-molecular electron attractive materials and the like.

Among the above electron transferring materials, para-diphenoquinone derivatives represented by the formula (4):

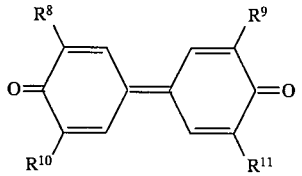

(4)

wherein $R^8$, $R^9$, $R^{10}$ and $R^{11}$ are the same or different and indicate a hydrogen atom, an alkyl group, a cycloalkyl group, an aryl group, an aralkyl group or an alkoxy group, are suitably used. Among them, unsymmetrical para-diphenoquinone derivatives such as para-diphenoquinone derivatives wherein two substituents of the substituents $R^8$, $R^9$, $R^{10}$ and $R^{11}$ indicate a lower straight-chain alkyl group and other two substituents indicate a branched alkyl, cycloalkyl, aryl or aralkyl group are used, most preferably, because they are superior in electron transferring properties and solubility to the binding resin.

Examples of the alkyl group include the respective groups described above.

On the other hand, examples of the hole transferring material include the following compounds:

pyrene, N-ethylcarbazole, N-isopropylcarbazole, N-methyl-N-phenylhydrazino-3-methylidine-9-carbazole, N,N-diphenylhydrazino-3-methylidene-9-ethylcarbazole, N,N-diphenylhydrazino-3-methylidene-10-ethylphenothiazine N,N-diphenylhydrazino-3-methylidene-10-ethylphenoxazine;

hydrazone salts such as p-diethylaminobenzaldehyde-N,N-diphenylhydrazone, p-diethylaminobenzaldehyde-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzazolinone-2-hydrazone;

2,5-bis(p-diethylaminophenyl)-1,3,4-oxadiazole;

pyrazolines such as 1-phenyl-3-(p-diethylaminostyryl)-5-(p-diethylaminophenyl)pyrazoline, 1-[quinonyl(2)]-3-(p-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[6-methoxy-pyridyl(2)]-3-(p-diethylaminostyryl)-5-(p-diethylaminophenyl)pyrazoline, 1-[pyridyl(3)]-3-(p-diethylaminostyryl)-5-(p-diethylaminophenyl)pyrazoline, 1-[lepidyl(3)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-3-(p-diethylaminophenyl)pyrazoline, 1-phenyl-3-(p-diethylaminostyryl)-4-methyl-5-(p-diethylaminophenyl)pyrazoline;

oxazoles such as 2-(p-diethylaminostyryl)-3-diethylaminobenzoxazole, 2-(p-diethylaminophenyl)-4-(p-diethylaminophenyl)-5-(2-chlorophenyl)oxazole;

thiazoles such as 2-(p-diethylamino-styryl)-6-diethylaminobenzothiazole;

triarylmethane compounds such as bis(4-diethylamino-2-methylphenyl)phenylmethane;

polyarylalkanes such as 1,1-bis(4-N,N-diethylamino-2-methylphenyl)heptane, 1,1,2,2-tetrakis(4-N,N-diethylamino-2-methylphenyl)ethane;

benzidine compounds such as N,N'-diphenyl-N,N'-bis(m-ethylphenyl)benzidine, N,N'-diphenyl-N,N'-bis(ethylphenyl)benzidine, N,N'-diphenyl-N,N'-bis(propylphenyl)benzidine, N,N'-diphenyl-N,N'-bis(butylphenyl)benzidine, N,N'-bis(isopropylphenyl)benzidine, N,N'-diphenyl-N,N'-bis(sec-butylphenyl)benzidine, N,N'-diphenyl-N,N'-bis(tert-butylphenyl)benzidine, N,N'-diphenyl-N,N'-bis(2,4-dimethylphenyl)benzidine, N,N'-diphenyl-N,N'-bis(chlorophenyl)benzidine;

triphenylamine, poly-N-vinylcarbazole, polyvinylpyrene, polyvinylanthracene, polyvinylacridine, poly-9-vinylphenylanthracene, pyrene-formaldehyde resin, ethylcarbazole formaldehyde resin.

Among the above hole transferring materials, benzidine compounds represented by the formula (5):

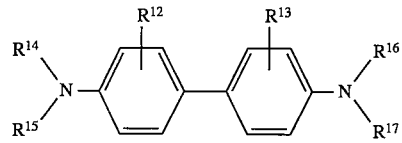

(5)

wherein $R^{12}$ and $R^{13}$ are the same or different and indicate a lower alkyl group such as methyl group, ethyl group; and $R^{14}$, $R^{15}$, $R^{16}$ and $R^{17}$ are the same or different and indicate an alkyl, cycloalkyl, aryl or aralkyl group having carbon atoms of not more than 18, and carbazolehydrazone compounds represented by the formula (6):

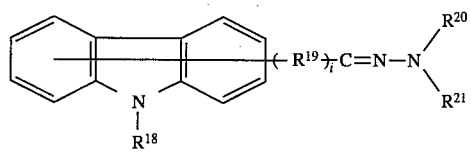

(6)

wherein $R^{18}$ is a hydrogen atom, an alkyl group or an acyl group; $R^{19}$ is a divalent organic group such as alkylene group; $R^{20}$ and $R^{21}$ are the same or different and indicate an alkyl, cycloalkyl, aryl or aralkyl group having carbon atoms of not more than 18; and i is an integer of 1 to 3, among hydrazole salts are used most preferably, because they are superior in hole transferring properties and solubility to the binding resin.

Examples of the alkyl group include the respective groups described above. Examples of the acyl group include formyl group, acetyl group, propionyl group, butyryl group, valeryl group, etc. Examples of the alkylene group include ethylene group, propylene group, butylene group, etc.

Among the respective components, the amount of the electric charge generating material is not specifically limited, but is preferably about 0.1 to 5% by weight, particularly about 0.25 to 2.5% by weight, based on the total amount (total amount of solid content) of the respective components constituting the single-layer type positive charging organic photosensitive layer. Further, the amount of the electron transferring material is preferably about 5 to 50% by weight, particularly about 10 to 40% by weight, based on the total amount of the solid content. Further, the amount of the hole transferring material is preferably about 5 to 50% by weight, particularly about 10 to 40% by weight, based on the total amount of the solid content. It is preferred to contain the electron transferring material and hole transferring material in the weight ratio of 1:9 to 9:1, particularly 2:8 to 8:2.

The single-layer type positive charging organic photosensitive layer is formed as follows. That is, the above respective components are dispersed/mixed with a suitable solvent using a roll mill, a ball mill, an atriter, a paint shaker, a supersonic dispenser, etc. to prepare a coating solution for photosensitive layer, which is applied on the surface of a conductive substrate by a dip coating method, a bar coating method, a spray coating method, a flow coating method, spin coating method, etc., followed by drying.

The concentration of the solid content of the coating solution can be suitably adjusted according to the method of coating onto the surface of the conductive substrate, and is preferably 5 to 50% by weight.

Various additives such as antioxidants, radical scavengers, singlet quenchers, ultraviolet absorbers, softeners, surface modifiers, antifoamers, bulking agents, thickners, dispersion stabilizers, wax, acceptors, donors can be appropriately contained in the coating solution, in addition to the above respective components, within such a range as not to exert a bad influence on characteristics of the photoconductor.

Furthermore, when steric hindering phenolic antioxidants are contained in an amount of about 0.1 to 50% by weight based on the total amount of the solid content, the durability of the photosensitive layer can be improved without exerting a bad influence on characteristics of the photoconductor.

As the conductive substrate, there can be used any substrate of various materials having the conductivity in various forms which fit to the structure of an image forming apparatus, such as drum, plate, sheet, etc. Examples of the material for the conductive substrate include metals such as aluminum, copper, tin, platinum, gold, silver, vanadium, molybdenum, chromium, cadmium, titanium, nickel, indium, stainless steel, brass; plastic materials vapor-deposited or laminated with the above metal; glass materials coated with aluminum iodide, tin oxide, indium oxide. Among them, there can be suitably used aluminum, particularly aluminum which has been subjected to anodizing so that the anodized film may become 1 to 50 μm, because no interference fringe is produced.

As the solvent for preparing the coating solution, there can be used various organic solvents, and examples thereof include alcohols such as methanol, ethanol, isopropanol, butanol; aliphatic hydrocarbons such as n-hexane, octane, cyclohexane; aromatic hydrocarbons such as benzene, toluene, xylene; halogenated hydrocarbons such as dichloromethane, dichloroethane, carbon tetrachloride, chlorobenzene; ethers such as dimethyl ether, diethyl ether, tetrahydrofuran, ethylene glycol dimethyl ether, diethylene glycol dimethyl ether; ketones such as acetone, methyl ethyl ketone, cyclohexanone; esters such as ethyl acetate, methyl acetate; dimethylformaldehyde, dimethylsulfoxide. These solvents may be used alone or in combination thereof according to the solubility of the above respective materials.

As described above, the toner for non-magnetic one-component development of the present invention can considerably reduce the generation of the image memory in the half tone development immediately after the development of the black solid part, particularly in the method for non-magnetic one-component contact type development.

EXAMPLES

The following Examples and Comparative Examples further illustrate the toner for non-magnetic one-component development of the present invention in detail.

Example 1

100 Parts by weight of a styrene-acrylate-butyl methacrylate copolymer as the fixing resin, 7.5 parts by weight of an electric charge controlling resin for controlling a positive charge [resin (commercially available as "FCA201PZ" from Fujikura Kasei Co., Ltd.) wherein a trialkylammonio group is introduced into the side chain of the styrene-acrylic resin)], 2.5 parts by weight of polypropylene wax as the release agent and 5 parts by weight of carbon black as the colorant were mixed and, after melting and kneading, the mixture was pulverized and classified to prepare a toner particle having an average particle size of 9 μm.

Then, 0.7 parts by weight of a hydrophobic silica particle [surface treating agent, commercially available as "RA130H" from Japan Aerogyl Co., Ltd.] was added to 100 parts by weight of the resulting toner particle to produce a positive charging toner for non-magnetic one-component development.

Example 2

According to the same manner as that described in Example 1 except that the amount of the hydrophobic silica particle to be added was 0.9 parts by weight, a positive charging toner for non-magnetic one-component development was produced.

Comparative Example

According to the same manner as that described in Example 1 except that the amount of the hydrophobic silica particle to be added was 0.1 parts by weight, a positive charging toner for non-magnetic one-component development was produced.

The toners obtained in the above respective Examples and Comparative Examples were subjected to the following tests and their characteristics were evaluated.

Measurement of Apparent Density

A toner (30 g) was taken in a container and the toner was gently poured on a funnel having a screen. Furthermore, a 30 cc receiver was placed under the funnel and the toner on the screen was stirred with a brush for 90 seconds to disperse and drop the toner. Then, the weight of the toner in the container was measured and the apparent density was calculated from the following equation.

Apparent density (g/cc) = (weight of toner)/(volume of container)

Charged Amount of New Toner

It means a charged amount of a toner which was additionally supplied to a developing roller immediately after the consumption of the toner at the black solid part. This charged amount was determined as follows. That is, a suction nozzle was pressed to the developing roller immediately after the consumption of the toner at the black solid part, and the toner on the developing roller was collected in a Faraday gauge with a vacuum pump to measure the charged amount of this collecting toner with an electrometer.

Image Density of Half Tone Part

The image density (A) of the half tone part developed immediately after the development of the black solid part was measured with a reflection densitometer [Model TC-6D, manufactured by Tokyo Denshoku Co., Ltd.]. Furthermore, the image density (B) of the half tone part printed after printing of the white part was measured according to the same manner as that described above to measure their change rate (A/B). Incidentally, a photoconductor used is a single-layer type positive charging organic photoconductor, which was produced as follows.

Production of Positive Charging Type Photoconductor

5 Parts by weight of metal-free phthalocyanine as the electric charge generating material, 40 parts by weight of N,N'-diphenyl-N,N'-bis(2,4-dimethylphenyl)benzidine as the hole transferring material, 40 parts by weight of 3,3',5,5'-tetraphenyldiphenoquinone as the electron transferring material and 100 parts by weight of polycarbonate as the binding resin were mixed and dispersed with 800 parts by weight of dichloromethane as the solvent with a paint shaker to prepare a coating solution. Then, this coating solution was applied on an aluminum tube by a dip coating method, followed by hot-air drying in a dark place at 60° C. for 60 minutes to produce a positive charging photoconductor drum having a single-layer type positive charging organic photosensitive layer of 15 μm in film thickness.

Furthermore, the development was conducted as follows.

As shown in FIG. 1, an image forming apparatus which comprises a contact type developing apparatus equipped with a developing roller 2 and a control blade 3, transfer and release chargers (not shown) for toner image formed on a photoconductor drum 4, and the positive charging photoconductor drum 4 produced above was prepared, in order to carry out the test.

A positive charging toner 1 was put in the developing apparatus and a d.c. voltage (developing bias) of −200 to −900 V was applied from a bias power to the developing roller 2 while rotating the drum 4 and developing roller 2 at the state where the drum 4 is grounded (0 V) to produce a potential difference between them.

Then, transfer and release chargers 5, 6 were operated to print out a paper at the state where a predetermined potential difference is maintained. Thereby, the image density of the above half tone part was measured.

The test results are shown in Table 1.

TABLE 1

| Example No. | Apparent density (g/cc) | Charged amount of new toner (μC/g) | Image density of half part BK* | Image density of half part WH** | Rate of change (%) |
|---|---|---|---|---|---|
| 1 | 0.32 | 7.00 | 0.430 | 0.430 | 1.000 |
| 2 | 0.34 | 9.00 | 0.440 | 0.440 | 1.000 |
| Comp. Ex. | 0.28 | 5.39 | 0.479 | 0.400 | 1.198 |

*"BK" indicates the value of the black solid part, which was obtained immediately after the development.
**"WH" indicates the value of the white part, which was obtained immediately after the development.

As is apparent from Table 1, regarding the toners of Examples 1 and 2, the apparent density is not less than 0.32 g/cc and the charged amount of the new toner is not less than 7 μC/g so that no image memory is generated, while the image memory is generated in the toner of Comparative Example 1 wherein the apparent density and charged amount of the new toner are lower than the above range, respectively.

What is claimed is:

1. A toner for non-magnetic one-component development, which is a positive charging toner used in combination with a positive charge type single-layer organic photoconductor, wherein an apparent density of said toner is not less than 0.32 g/cc, and when supplying said toner to a developing roller immediately after the consumption at a black solid part, a charged amount is not less than 7 μC/g as an absolute value.

2. The toner for non-magnetic one-component development according to claim 1, which is used in combination with an organic photoconductor.

3. The toner for non-magnetic one-component development according to claim 1, which contains an electric charge controlling resin containing a trialkylammoniom group at the side chain.

4. A method for contact type development, comprising the steps of:

charging the positive charging toner of claim 1 by friction charging with a developing roller, to which a developing bias has been applied, to form a thin film of the toner on the surface of the developing roller; and bringing the toner thin film into contact with an electrostatic latent image formed on the surface of a positive charging type single-layer organic photoconductor to visualize the electrostatic latent image.

5. The method for contact type development according to claim 4, wherein the surface of the photocondutor is charged to the same polarity as that of the toner, and then the photoconductor is exposed to light to form an electrostatic latent image of which potential is lower than a developing bias.

6. The toner according to claim 1 which has an apparent density of 0.33 to 0.40 g/cc.

7. The toner according to claim 1 where in the change amount is 10 to 30 μC/g.

* * * * *